US005840637A

United States Patent [19]

Denton et al.

[11] Patent Number: 5,840,637

[45] Date of Patent: Nov. 24, 1998

[54] YARNS OF COVERED HIGH MODULUS MATERIAL AND FABRICS FORMED THEREFROM

[75] Inventors: Jeffrey Scott Denton, Mendon; Dana Burton Eagles, Sherborn; Joseph Gerald O'Connor, Hopedale; Robert Bernard Davis, Framingham, all of Mass.

[73] Assignee: Albany International Corporation, Albany, N.Y.

[21] Appl. No.: 710,488

[22] Filed: Sep. 18, 1996

Related U.S. Application Data

[63] Continuation-in-part of Ser. No. 714,856, Sep. 17, 1996.

[51] Int. Cl.[6] ..... D03D 3/00

[52] U.S. Cl. ..... 442/200; 442/311; 442/199; 428/373; 428/374; 139/420 A

[58] Field of Search ..... 442/199, 200, 442/311; 428/373, 374, 364; 139/420 A

[56] References Cited

U.S. PATENT DOCUMENTS

| | | | |
|---|---|---|---|
| 4,927,698 | 5/1990 | Jaco et al. | 428/198 |
| 5,527,597 | 6/1996 | Stanhope et al. | 139/426 R |
| 5,549,967 | 8/1996 | Gstrein | 442/200 |
| 5,617,903 | 4/1997 | Bowen, Jr. | 442/200 |

*Primary Examiner*—Patrick Ryan
*Assistant Examiner*—J. M. Gray
*Attorney, Agent, or Firm*—Kane, Dalsimer, Sullivan, Kurucz, Levy, Eisele and Richard, LLP

[57] ABSTRACT

The present invention is directed towards fabrics formed from yarns of a composite filament structure. The composite filament structure is a high modulus filament material covered with bicomponent filaments and the entire surface area of the high modulus material should be covered. The fabric can be used in clothings for paper making machines and other industrial uses.

13 Claims, 2 Drawing Sheets

YARNS OF COVERED HIGH MODULUS MATERIAL AND FABRICS FORMED THEREFROM

This application is a continuation-in-part of pending U.S. application Ser. No. 08/714,856, filed Sep. 17, 1996.

FIELD OF THE INVENTION

The present direction is directed to yarns of high modulus materials, such as polymer materials, covered within a second material. The yarns can be used to construct fabrics used in clothings for paper making machines and other industrial fabrics.

BACKGROUND OF THE INVENTION

Paper machine clothing is the term for industrial fabrics used on paper machines in the forming, pressing and drying sections. They are generally fabricated with either polyester or polyamide multifilaments and/or monofilaments woven on conventional, large textile looms. These fabrics have generally been fabricated by conventional weaving techniques.

The primary function of all paper machine clothing (PMC) is removal of water from the paper sheet. As both the manufacturer of paper making machine and papermaker work to increase the speed of the papermaking process and improve paper quality, new barriers have been identified for PMC fabrics that demand innovation in materials and fabric design. Furthermore, the PMC manufacturer is also looking for more efficient production of PMC fabrics and enhancing key quality characteristics of the same.

Today, paper making machines are attaining such rapid speeds that the thickness of the fabric structure is beginning to limit the rate of water removal, especially in the forming section. Insufficient dewatering results in low sheet strength. Sheet strength is critical for transferring and maintaining sheet properties through the next, more aggressive stages of sheet dewatering. One possible solution is to lengthen the forming section of the machine, but this is rather expensive and therefore of limited viability. The other approach is for the PMC manufacturer to produce thinner fabrics, but in a weaving process the smallest possible dimensions are the combined diameters of the filaments used in the warp and shute directions. Criteria such as dimensional stability, fabric strength and fabric life result in a practical limit to the fineness of the filament diameter and thus the overall thickness of the fabric. In many PMC positions, a tradeoff of these properties is not feasible or practical, and in fact higher machine speeds actually require further enhancement of these properties.

There is a definite need for high strength, low weight, relatively thinner clothings than those which are presently available.

The surface topography of PMC fabrics contributes to the quality of the paper product. Efforts have been made to create a smoother contact surface with the paper sheet. However, surface smoothness of PMC woven fabrics is limited by the topography resulting from the weave pattern and the filament physical properties. In a woven fabric (or knitted fabric), smoothness is inherently limited by the knuckles formed at the cross-over points of intersecting yarns.

High modulus materials are potential materials for use in applications requiring high mechanical properties and light weight. On a property-weight basis, high modulus polymers have a distinct advantage over metals and ceramics.

High modulus polymers are highly anisotropic, and high modulus is achieved only in the direction of molecular chain orientation. In fact, properties normal to the molecular axis exhibit considerably lower values than the properties exhibited in the longitudinal direction. As a result, low shear and compressive properties are exhibited in the direction normal to the molecular axis.

Composite design concepts are known in the art in order to compensate for the discrepancy in properties. Representative is U.S. Pat. No. 4,927,698 which discloses yarns of a core of fire-resistant filaments such as KEVLAR® and NOMEX® within a sheath of shrinkable staple fibers such as yarns which appear to be chemically bonded to the fire-resistant core through the reactions between a first cross-linkable resin, a second cross-linkable resin, the KEVLAR® /NOMEX® component, and the staple fiber component.

SUMMARY OF THE INVENTION

The present invention is directed towards yarns of covered high modulus filament materials and fabrics which are formed therefrom. The present invention is intended to provide a composite filamentary material which exhibits the advantages of high modulus materials while providing a means for compensating the diminished properties exhibited by such fibers in the direction normal to molecular chain orientation.

The present invention is a composite filament structure wherein a high modulus filament material is covered with bicomponent filaments. The composite filament structure has a first interior layer of high modulus filament material and a second exterior layer of bicomponent fibers, the second exterior layer of bicomponent fibers being covered around the first interior layer of high modulus material along its entire length. The entire surface area of the high modulus material should be covered.

The bicomponent fibers of the present invention may be either a sheath-core arrangement or a side-by-side arrangement, with sheath-core being preferred. It is further preferred that the sheath component have a melting point lower than the core component.

Suitable bicomponent fibers include sheath-core combinations of co-polyester/poly(ethylene terephthalate), polyamide/poly (ethylene terephthalate), polyamide/polyamide, polyethylene/poly (ethylene terephthalate), polypropylene/poly(ethylene terephthalate), polyethylene/polyamide, polypropylene/polyamide, thermoplastic polyurethane/polyamide and thermoplastic polyurethane/poly(ethylene terephthalate.

"Modulus", as used herein, refers to the tensile modulus as defined by the slope of the initial linear portion of the load extension response (stress-strain curve) of a specimen deformed at room temperature.

High modulus material, as used herein, includes high modulus polymers that exhibit tensile modulus greater than about 25% of theory. Alternatively, a high modulus polymer is one possessing a tensile modulus greater than about 25 GPA. *Encyclopedia of Polymer Science* 2d ed. vol 7, pp. 699–722. It should be noted that highly oriented polymer structures are anisotropic, and as modulus is increased by raising the degree of molecular chain orientation, modulus decreases commensurately in other directions.

Suitable high modulus polymers include, but are not limited to aramids such as poly(p-phenyleneterephthalamide), available from Dupont under the tradename KEVLAR®, other aramids such as KEV- LAR® (available from Rhone-Poulenc) ARENKA®, available from Akzo, Nomex (available from DuPont), polyethylene naphthalate (PEN), poly(p-phenylene benzobisthiazole), polyesters, glass, aromatic polyamide resins ARENKA®, an aramid available from Akzo, thermotropic copolyesters such as VECTRA® (Celanese) and XYDAR® (Dart), high modulus polyethylene fibers such as Spectra 900 (Allied).

The skilled artisan should appreciate that there are several ways in which the high modulus interior could be covered, such as braiding and wrapping. A braid of bicomponent fibers around the high modulus interior provides a structure with good stability. Wrapping the high modulus fibers with the bicomponent fiber material is another suitable method. Fibers could be covered with either a single covering machine or a double covering machine. In either case, the core fibers are spirally covered at a selected pitch.

In constructing fabrics of the present invention, advantage is taken of the unique structure of bicomponent filament. The melting point of the sheath component is lower than the melting point of the core component, and lower than the melting point of the high modulus interior. Improved structural integrity is imparted by heating the fabric, which has been formed from the yarns, which intersect each other in the fabric, to a temperature in excess of the melting point of the sheath but lower than the melting point of the core and high modulus interior, followed by subsequent cooling. This process, hereinafter referred to heat fusion, causes the sheath components of the bicomponent fibers to enter a softened state, and accordingly, the yarns fuse together at contact points when cooled to temperatures below the melting point of the sheath material. For the most part, such contact points are the points where the yarns intersect each other.

Due to the improved stability of the fabrics of the present invention, it is believed that a single layer fabric constructed of the composite yarns of the present invention could successfully run on a paper making machine. That is, the present invention provides a means for producing single layered fabrics able to withstand the demanding conditions which paper machine clothings are subjected to. Generally, fabrics must be constructed of at least two layers to insure that the fabrics have the necessary dimensional stability and strength in order to withstand the demanding running conditions.

The present invention could also be used as the top laminate structure of a multilayer structure, and it is believed that its use as such a layer would offer advantages over conventional materials due to reduced knuckle size on the surface of the fabric and reduced caliper of the fabric. Reduced knuckle size would create a smoother fabric surface, a feature desired by paper makers. It is also possible that a thinner fabric can be made using the high modulus composite yarns of the present invention since the excellent tensile properties possessed by high modulus materials means that less material could be used to attain the degree of strength possessed by conventional fabrics. The present invention may also be used as the base layer of a multilayer structure. The improved dimensional stability of this layer makes it well suited for this usage. Using a fabric according to the invention as a base layer would impart certain advantages to the overall fabric construction. Because the composite yarns of the present invention exhibit a relatively high degree of strength along the axis of the yarn, the use of this fabric layer as the base layer would provide the stability and strength required of the overall fabric structure. Therefore, less rigid materials could be used in other fabric layers, enabling the paper maker to, for example, select fibers of fine denier to construct other layers. Accordingly, fabrics could be made thinner in this way as well. A thinner fabric is desirable since drainage properties would be improved.

In a preferred embodiment of the invention, the yarns of the present invention are the sole constituents of at least one layer of a clothing. In the case of multiple layer clothing, at least one layer is constructed of the yarns of the present invention, and preferably constitute the surface layer in contact with the paper sheet. Whether the fabric is a single layer or multiple layer, the bicomponent fibers are to be arranged in an orderly non-random manner. By arranged in an orderly non-random manner, it is meant that fibers of a clothing run in a first direction; the first direction fibers do not intersect with other fibers running in the first direction; and that fibers of the clothing run in a second direction; the second direction fibers do not intersect with other fibers running in the second direction; that fibers running in the first direction intersect with fibers running in the second direction, and vice versa. For instance, fibers arranged in the machine direction will not intersect with each other and such fibers will intersect only with fibers running in the cross machine direction. It is preferred that the clothings of the present invention be constructed of fibers running in the machine or cross machine direction, but such clothings could be constructed of fibers which run in directions that are at angles to the machine and cross machine direction of a paper making machine.

DETAILED DESCRIPTION OF THE PREFERRED EMBODIMENT

Figure 1:
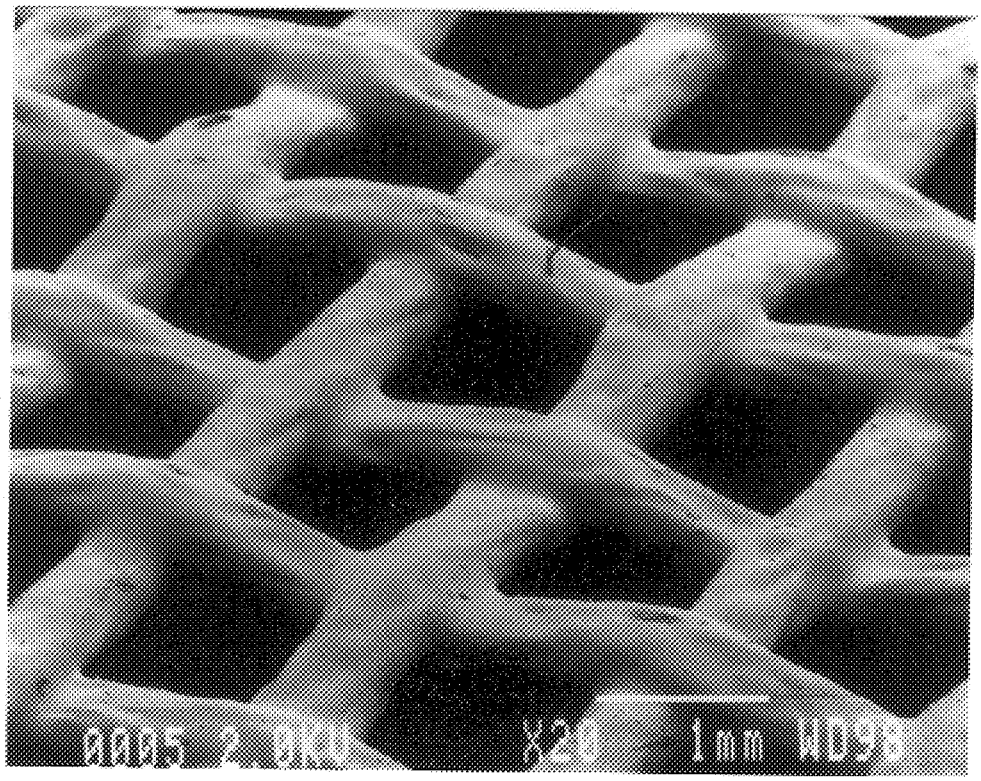
FIG. 1 is a composite braided fabric of the present invention.

FIG. 1 is a fabric comprised of yarns of the present invention. The fabric is a plain weave construction, with yarns in the warp and shute direction being comprised of yarns of the present invention. It can be observed from FIG. 1 that the yarns are interconnected with other yarns at the points at which the yarns intersect. This is attributable to heat fusion of the yarns, wherein the sheaths of the bicomponent materials fuse to each other after heating the fabric to a temperature above the melting point of the sheath material, yet lower than the melting point of the core material.

Both the warp and shute yarns of the fabric shown in FIG. 1 are of the same structure. The high modulus interior of the yarns are about 134 filaments of KEVLAR® 49. Eight bicomponent yarns have been braided around the KEVLAR® interior. Each yarn is constituted of sixteen (16) bicomponent filaments. The filaments are BELLCOUPLE® from Kanebo, 250 denier, 16 filament count having a low melt copolyester sheath material and a poly(ethylene terephthalate) core, with the melting point of the copolyester sheath being lower than the melting point of the PET core.

The eight bicomponent yarns are braided around the KEVLAR® interior. Braiding forms a relatively stable structure, and the covered high modulus yarns can be used to form fabrics as shown in FIG. 1. Such fabrics are formed according to methods readily appreciated to one skilled in the art. After the fabric has been formed, it is placed under tension, heated to a temperature greater than the melting point of the sheath, yet lower than the melting point of the core, and then cooled to a temperature lower than the melting point of the sheath.

Due to the improved stability of the fabrics of the present invention, it is believed that a single layer fabric constructed of the composite yarns of the present invention could successfully run on a paper making machine. That is, the present invention provides a means for producing single layered fabrics able to withstand the demanding conditions which paper machine clothings are subjected to.

Generally, fabrics must be constructed of at least two layers to insure that the fabrics have the necessary dimensional stability and strength in order to withstand the demanding running conditions. Yet because the paper machine clothings of the present invention are characterized by high modulus, low stretch materials, the stiffness and dimensional stability of the fabric is provided by the layer of high modulus materials and accordingly, one layer fabrics are possible. In other words, because of the high degree of strength provided by such materials, it is possible to use less material in constructing a fabric while imparting equal or even greater strength when compared to multi layer materials which contain considerably more material. Achieving a single layer fabric design would be a substantial breakthrough in PMC design. As machine speed increases, reducing the amount of time for drainage, the ability to achieve the smallest possible caliper becomes more significant, since a single layer fabric would be thinner than a multi-layer fabric, reducing the distance liquid must traverse in order to drain.

The present invention could also be used as the top laminate structure of a multilayer structure, and it is believed that its use as such a layer would offer advantages over conventional materials due to increased planarity on the surface. Increased planarity is the result of reduced knuckle size at points where yarns intersect. Upon heat fusion of the fabric, the low-melt component of the bicomponent fiber collapses and flows, reducing the knuckle size of the cross-over points.

The present invention may also be used as the base layer of a multilayer structure. The improved dimensional stability of this layer makes it well-suited for this usage. Thus, other materials, such as those of fine diameters, can be used in other layers, since stability and strength is imparted by the layer constructed of the high modulus material. The use of fine diameter materials in paper-sheet contacting layers would improve surface smoothness, a desirable feature of paper machine clothings.

Figure 2:
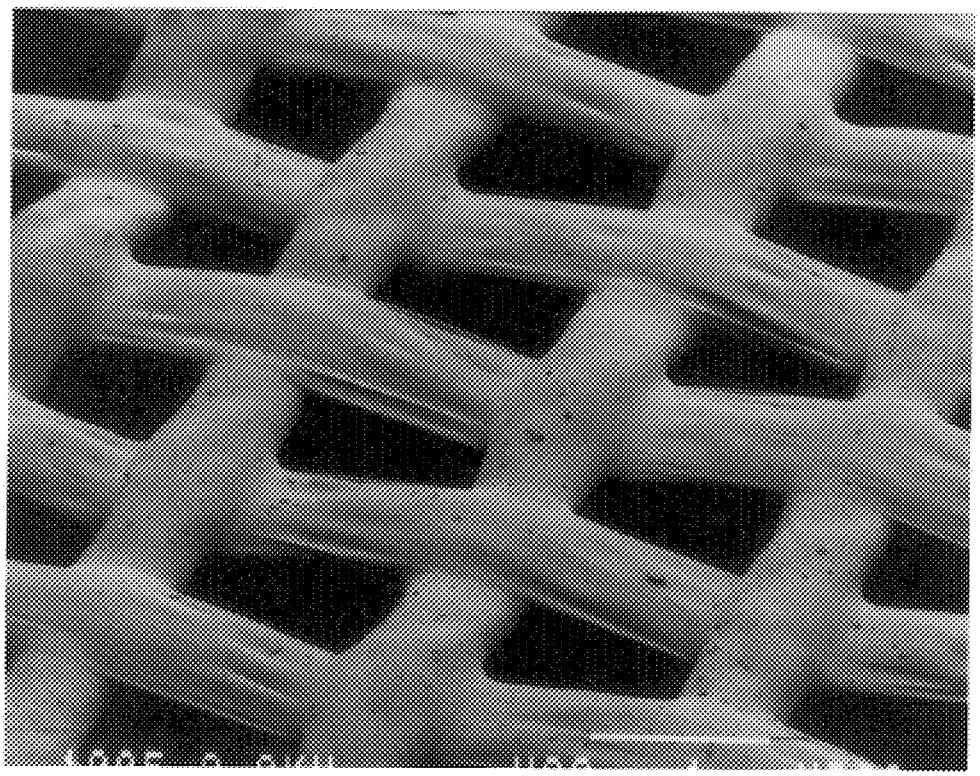
FIG. 2 is another composite braided fabric of the present invention.

FIG. 2 shows a fabric wherein the yarns described in relation to FIG. 1 above are used in the warp direction. The shute direction yarns are comprised of 9 ply material. That is, they are a ply of nine yarns of bicomponent material as described in FIG. 1. The plied yarns are twisted loosely together. The yarns have a distinctly flattened appearance. That is, after heat fusion, the yarns take on a ribbon like appearance.

Figure 3:
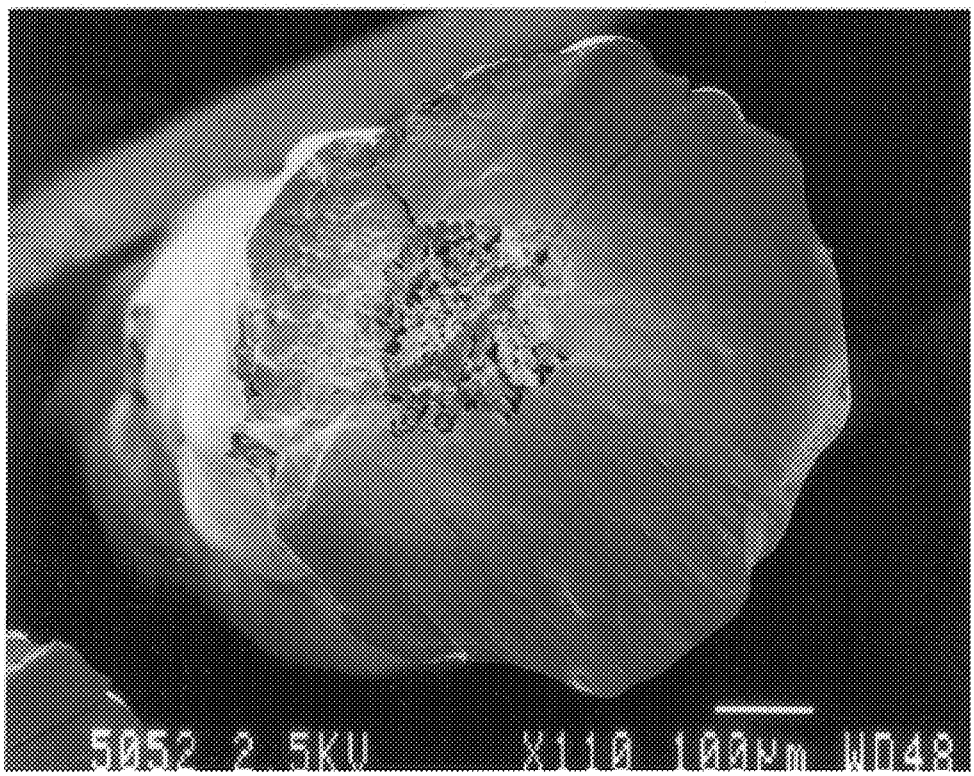
FIG. 3 is a cross section of a yarn of the present invention.

FIG. 3 shows a cross section of a composite yarn according to the present invention. The KEVLAR® interior is visible as a distinct region. The bicomponent exterior is not discrete.

When running on a paper making machine, a fabric according to the present invention should remain cleaner than a clothing comprised of conventional monofilaments. Heat fusion of a fabric comprised of bicomponent fibers are characterized in part by fused, intersecting yarns. In contrast, conventional monofilaments have interstices at points where yarns intersect. Fusion at the intersections of bicomponent fibers diminishes, and possibly eliminates, such interstices. Interstices are pinch points at which debris can be entrapped and collect over time. Accordingly, the heat fused intersecting yarns produced with bicomponent fibers provides a structure that should remain relatively cleaner than a clothing comprised of conventional monofilaments.

Another advantage that paper machine clothings of the present invention are believed to possess over conventional clothings comprised of monofilaments is that such clothings exhibit relatively planar, knuckle free surfaces at cross over points. It can be readily appreciated that when fibers are woven (or knitted), knuckles are formed which diminish surface smoothness. As noted, knuckle size is reduced upon heat fusion of the bicomponent fibers, which improves the surface smoothness. Surface smoothness is a factor which affects paper quality. Accordingly, clothings of improved smoothness are of interest to the manufacturer of paper and related products. A network of bonds between intersecting fibers will be formed upon heat fusion of a clothing comprised of bicomponent fibers. Physical bonding of this kind will improve the dimensional stability over a conventional clothing constructed of monofilament. Because of the nature of bicomponent fibers and the unique structures they may form, fibers of denier lower than those required for conventional monofilaments can be used. The use of lower denier fibers offers the advantage of a clothing thinner than a clothing comprised of conventional monofilament, without sacrificing fabric strength.

We claim:

1. A fabric for use in the forming, pressing, or drying sections of a paper making machine, the fabric having at least one layer comprised of a composite yarn comprised of:

a first yarn of high modulus filamentary material within a second yarn;

wherein the second yarn is a bicomponent filamentary material, the bicomponent filamentary material having a sheath component and a core component, wherein the bicomponent filamentary material covers the first, high modulus filamentary material and encases the first, high modulus filamentary material along the length of the composite yarn.

2. The fabric as set forth in claim 1 wherein the yarns comprising the fabric are woven.

3. The fabric as set forth in claim 1 wherein the yarns comprising the fabric are knitted.

4. The fabric as set forth in claim 1 wherein the composite yarns extend in the warp and shute directions.

5. The fabric as set forth in claim 1 wherein the composite yarns extend in the warp direction.

6. The fabric as set forth in claim 1 wherein the composite yarns extend in the shute direction.

7. The fabric of claim 1 wherein the first, high modulus material is selected from the group consisting of high modulus polyamides, aramids, poly(ethylene naphthalate), glass fiber, thermotropic aromatic copolyesters, poly(p-phenylene benzobisthiazole), polyesters, and high modulus polyethylene fibers, and mixtures thereof.

8. The fabric of claim 1 wherein the sheath-core combinations of the bicomponent fibers are selected from the group consisting of combinations of co-polyester/poly (ethylene terephthalate), polyamide/poly (ethylene terephthalate), polyamide/polyamide, polyethylene/poly (ethylene terephthalate), polypropylene/poly (ethylene terephthalate), polyethylene/polyamide, polypropylene/polyamide, thermoplastic polyurethane/polyamide and thermoplastic polyurethane/poly (ethylene terephthalate).

9. The fabric of claim 1, wherein a plurality of high modulus filaments are encased within the first, high modulus filamentary material.

10. The fabric of claim 1 wherein the bicomponent filamentary material is further comprised of a plurality of bicomponent filaments having sheath core arrangements.

11. The fabric of claim 1 wherein the fabric is heated to a temperature greater than the melting point of the sheath component yet lower then the melting point of the core component and cooled to a temperature lower than the melting point of the sheath component.

12. The fabric of claim 1 wherein the composite yarn is heat fused prior to formation of the fabric.

13. The fabric of claim 1 wherein the fabric is a single-layer fabric.

* * * * *